US010080426B2

(12) United States Patent
Harris

(10) Patent No.: US 10,080,426 B2
(45) Date of Patent: Sep. 25, 2018

(54) PINKY BARBER BRUSH

(71) Applicant: Dennis H. Harris, Benton, AR (US)

(72) Inventor: Dennis H. Harris, Benton, AR (US)

(73) Assignee: Doc Fader's Pinky Barber Brush, LLC, Little Rock, AR (US)

( * ) Notice: Subject to any disclaimer, the term of this patent is extended or adjusted under 35 U.S.C. 154(b) by 84 days.

(21) Appl. No.: 14/937,926

(22) Filed: Nov. 11, 2015

(65) Prior Publication Data

US 2017/0127788 A1 May 11, 2017

(51) Int. Cl.

| | |
|---|---|
| ***A46B 5/04*** | (2006.01) |
| ***A45D 27/46*** | (2006.01) |
| ***B26B 19/38*** | (2006.01) |
| ***B08B 1/00*** | (2006.01) |
| *A45D 24/14* | (2006.01) |

(52) U.S. Cl.

CPC ..... *A46B 5/04* (2013.01); *A45D 27/46* (2013.01); *B08B 1/002* (2013.01); *B26B 19/3826* (2013.01); *A45D 24/14* (2013.01)

(58) Field of Classification Search

CPC ..... A47L 13/16; A47L 13/18; A46B 5/04; A45D 24/14; A45D 27/46; B26B 19/3826

USPC ..... 15/227

See application file for complete search history.

(56) References Cited

U.S. PATENT DOCUMENTS

| | | | | | |
|---|---|---|---|---|---|
| 2,396,548 | A * | 3/1946 | Allen | A46B 5/04 | 15/167.1 |
| 4,617,694 | A * | 10/1986 | Bori | A46B 5/04 | 132/308 |
| 5,287,584 | A * | 2/1994 | Skinner | A46B 5/04 | 15/167.1 |
| D532,005 | S * | 11/2006 | Leith | D14/253 | |
| 8,479,749 | B2 * | 7/2013 | Randolph | A45D 24/14 | 132/120 |
| 2010/0101594 | A1 * | 4/2010 | Pulfrey | A46B 9/023 | 132/120 |
| 2014/0053860 | A1 * | 2/2014 | Temple | A45D 24/16 | 132/200 |

* cited by examiner

*Primary Examiner* — Laura C Guidotti
(74) *Attorney, Agent, or Firm* — Rashauna Norment

(57) ABSTRACT

In some preferred embodiments, the present invention provides an improved system and apparatus for cleaning the clipper blades at an intermediate step of hair cutting, to avoid hindrance of the hair sticking the blades. This ensures better handling and operation of the hair cutting tools. The apparatus can be removably worn any of the fingers of the Barber, as per the comfort and ease of operations felt by him. The invention suggests a cleaning barber brush apparatus that is conveniently adjusted to be worn in different fingers of different sizes, using elastic and rubber holding means.

18 Claims, 1 Drawing Sheet

PINKY BARBER BRUSH

CROSS REFERENCE TO RELATED APPLICATION

Not Applicable

FEDERALLY SPONSORED RESEARCH AND DEVELOPMENT

Not Applicable

MICROFICHE APPENDIX

Not Applicable

BACKGROUND OF THE INVENTION (1) Field of the Invention The present invention relates to the field of cleaning brushes and more particularly to brushes for cleaning clipper blades by a barber during hair cutting process, without moving away from the cutting station, to reduce the time used in the cutting process.

(2) Background of the Invention

Professional hair groomers deal with a large amount of hair during the grooming process. Hair accumulates on the grooming table, floor, and in the tools used. Much of this hair is physically handled by the groomer as he/she manually removes accumulated hair from various hand tools such as slicker brushes, combs, and rakes. In this latter case, the groomer must use both hands and either drops extracted hair on the floor or deposits such into a waste receptacle. Almost everyone likes hair be cleaned up after grooming each person before another can be groomed at the same workstation. In practice, either hair accumulates on the tools including the clipper blades, combs and brushes etc used in hair cutting process. Clean-up time can be a substantial portion of the total time allocated to groom a person because the cut hair strands may tend to accumulate in between the clipper blades with use. Cut hair which remains between the two blades can create a space between the blades which reduces the blades' cutting ability. However, it is difficult to clean the area between the blades with a brush or the like without disassembling the blades. Thus, there is a need for methods and apparatus for more easily and efficiently removing cut hair strands from between the blades in hair clippers. There is also a need for methods and apparatus for cleaning between the blades in hair clippers without disassembling the blades.

There is a constant also a need to keep razor blades' edges sharp and to extend the life of the blades. The fact is, the useful life of a razor blade is typically undermined by common, but poor blade-cleaning processes. The common "water faucet method" of cleaning razor blades often does not fully clean the soaps and residue under the blade's cavity, which creates serious limitations to a razor's blade useful life. Moreover this requires the barber to move away from the work station and indulge in cleaning.

The prior patents disclose the concept of Cleaning brushes as explained in Razor blade cleaning brush "WO 2012121806 A2" to Terrence J. LAVERY which puts forth an inexpensive razor-cleaning brush which is made from a modified toothbrush mold and includes side guards thereon to render the brush not usable as a toothbrush and to provide for a clear visual indication that said razor-cleaning brush is not a toothbrush.

Another prior art Method and apparatus for cleaning hair clipper blades 'U.S. Pat. No. 5,426,811 A" discloses a tool for cleaning between hair clipper blades includes an elongated handle with a comb at one end of the handle. The comb has a plurality of spaced teeth separated by openings, and a finger at one end of the comb. In use, the finger is inserted between the clipper blades, separating them so that the comb can be passed through the space between the blades, removing unwanted matter such as uncut hair strands. Further Method for removing hair from a hand-held grooming tool "U.S. Pat. No. 8,732,893 B2" as proposed by James E. Freidell gives forth a vacuum cleaning tool for removing animal hair from nearly any hand-held grooming tool is disclosed. A vacuum grooming tool is also disclosed. A vacuum plenum of the cleaning tool is attachable to a vacuum source and has an opening for cleaning a grooming tool in one pass.

Accordingly, there exists a need for an easy to wear brush on barber's fingers to be used as cleaning tool for the clipper blade without going away from the workstation. Further, there exists a need for an adjustable cleaning apparatus that can be easily used and adjusted in all fingers of hand of all possible sizes. Moreover, there exists a need for a hand held cleaning tool for barber tools to fasten the hair cutting operation and decrease the time lag due to intermediate cleaning of blades required during cutting, in a convenient and easy manner.

To overcome the shortcomings, the present invention provides a cleaning brush to mitigate or obviate the aforementioned problems.

SUMMARY

The present invention provides new and improved hand held tool for cleaning of clipper blades. As such, the general purpose of the present invention, which will be described subsequently in greater detail, is to provide a new and improved system and method for cleaning the clipper blades at an intermediate step of hair cutting, to avoid hindrance of the hair sticking the blades which has all the advantages of the prior art and none of the disadvantages.

The present invention provides an improved system and apparatus for cleaning the clipper blades at an intermediate step of hair cutting, to avoid hindrance of the hair sticking the blades. The apparatus can be removably worn on fingers of the Barber. The invention suggests a cleaning barber brush apparatus that is conveniently adjusted to be worn in different fingers of different sizes, using elastic and rubber holding means.

A primary objective of the present invention is to provide apparatus for cleaning the clipper blades having advantages not taught by the prior art.

Accordingly, one object of this invention is to provide new and improved methods and apparatus for removing cut hair strands and other debris from between hair clipper blades without moving away from the workstation.

Another object is to provide new and improved methods and apparatus for more easily and efficiently cleaning between the blades in hair clippers, without disassembling the blades.

Another object is to provide new and improved methods and apparatus that can be conveniently adjusted according to the user's finger size.

A still further objective is to provide such a cleaning apparatus which is made from rubber and soft bristles.

A still further objective is to provide such a cleaning apparatus which is made from elastic and soft bristles.

A still further objective is to provide such a cleaning apparatus which cuts down the time taken by the barber for hair cutting.

Further, it is an object of the present invention to provide system and which is much more flexible and economical to use and can be utilized for all sizes of fingers.

Other features and advantages of the present invention will become apparent from the following more detailed description, taken in conjunction with the accompanying drawings, which illustrate, by way of example, the principles of the invention.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

To further clarify various aspects of some example embodiments of the present invention, a more particular description of the invention will be rendered by reference to specific embodiments thereof which are illustrated in the appended drawing. It is appreciated that the drawing depicts only illustrated embodiments of the invention and are therefore not to be considered limiting of its scope. The invention will be described and explained with additional specificity and detail through the use of the accompanying drawing in which.

DETAILED DESCRIPTION OF THE INVENTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

It is a widely known that most modern electric hair clippers have a stationary blade and a reciprocating blade. The stationary blade has a substantially straight row of spaced teeth, and the reciprocating blade has a row of teeth which correspond to and complement the stationary teeth. The reciprocating teeth are pressed against the stationary teeth by spring tension, and move back and forth across the stationary teeth in operation, cutting hair strands which enter spaces between the stationary teeth.

In some preferred embodiments, the present invention provides an improved system and apparatus for cleaning the clipper blades at an intermediate step of hair cutting, to avoid hindrance of the hair sticking the blades. This ensures better handling and operation of the hair cutting tools. The apparatus can be removably worn any of the fingers of the Barber, as per the comfort and ease of operations felt by him. The invention suggests a cleaning barber brush apparatus that is conveniently adjusted to be worn in different fingers of different sizes, using elastic and rubber holding means.

This section summarizes some aspects of the present disclosure and briefly introduces some preferred embodiments. Simplifications or omissions in this section as well as in the abstract or the title of this description may be made to avoid obscuring the purpose of this section, the abstract and the title. Such simplifications or omissions are not intended to limit the scope of the present disclosure nor imply any limitations.

Figure 1:
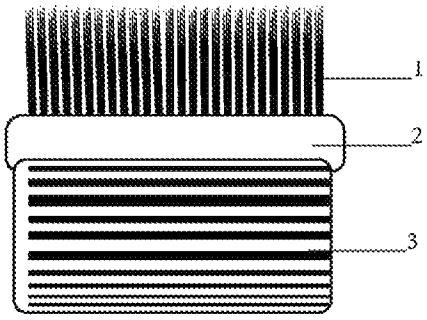
FIG. 1 is a front view of the present invention.
Figure 2:
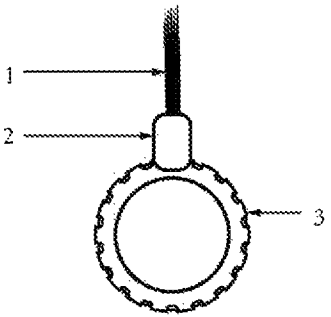
FIG. 2 is a side view of the present invention.
Figure 3:
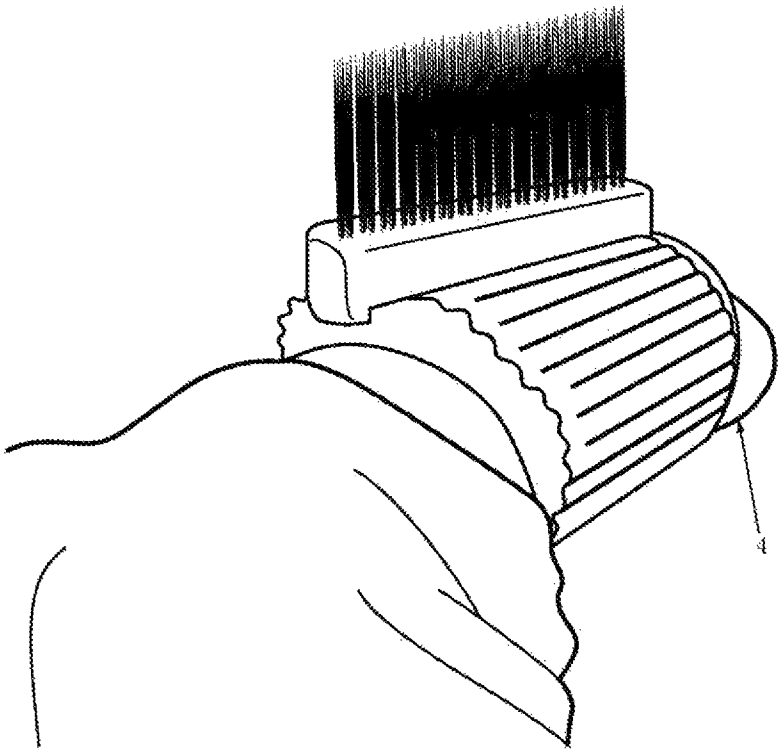
FIG. 3 is a perspective view of the invention.

Generally speaking, this invention discloses system and method for clippers cleaning apparatus at an intermediate step of cutting process. With reference to FIG. 1-3, the present invention provides a useful tool to clean the clipper blades while cutting the hair at workstation by the barber. As illustrated in FIGS. 1 and 2, the tool consists of three components: cleaning means 1, base or attaching means 2 of the cleaning means and holding means 3. The invention provides new and improved methods and apparatus for removing cut hair strands and other debris from between hair clipper blades without moving away from the workstation, thereby saving the time spent in hair cutting. The apparatus FIG. 3 can be conveniently adjusted according to the user's finger size 4 using the holding means 3. The apparatus is easy to use and comfortable to wear during the process of hair cutting.

In a preferred embodiment of the invention the cleaning apparatus has the holding means made from rubber and cleaning means made from soft bristles.

In another preferred embodiment of the invention the cleaning apparatus has the holding means made from elastic and cleaning means made from soft bristles.

The system of cleaning brush apparatus includes:

A cleaning means preferably soft bristles;

A holding means preferably made from rubber or plastic;

An attaching means preferably plastic between the cleaning means and the holding means which is used for joining the cleaning means and the holding means.

The method of cleaning brush apparatus includes steps:

Stretching the holding means to fit in the finger desired by the user to wear the apparatus;

Arranging the cleaning means perpendicular to the holding means;

Moving the finger with the apparatus in left to right (or vice versa movements), as desired according to the direction of the hair sticking on the clipper blade to be cleaned;

Repeating the movement of finger with the apparatus on it until the blade is cleaned.

The purpose and advantages of the invention is to provide user friendly, easy to use and thoroughly clean the clipper blade that is conveniently used by persons with different finger size. The invention apparatus ensures that the barber is able to clean the clipper blades, while cutting the hair, without moving away from the workstation.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

I claim:

1. A barber brush apparatus worn by a user during a hair cutting session to remove cut hair and debris from the cutting blades of a clipper apparatus, the brush apparatus comprising:

a. a contoured, rigid base;

b. a plurality of upstanding bristle members secured and supported within the base; and c. a tubular holder having a plurality of spaced raised ridge members arranged along the length of the holder, a depression defined along the length of the holder, and a longitudinal bore defined within the holder therethrough, with at least the bore being made from a stretchable material for adapting and adjusting the size of the bore to the size of the user's finger, with the base being seated and affixed within the holder depression, wherein the base has a longer length than the holder, wherein the ends of the base overhang the holder, d. wherein the holder is adapted for insertion over at least one of the user's fingers, with the base and the plurality of bristle members being positioned upwardly and outwardly from the user's hand so that movement of the user's hand, and thereby the bristle members, about the clipper blades to remove the cut hair and debris, and wherein the stretchable material within the holder adapted to remain on the user's finger until removed.

2. The barber brush apparatus of claim 1, each of the plurality of bristle members comprising soft bristles.

3. The barber brush apparatus of claim 2, the plurality of bristle members further comprising a proximate portion at the base of the apparatus and a distal portion opposite the base of the apparatus, with the distal portion of the bristle members tapering to a terminal end of the bristle members.

4. The barber brush apparatus of claim 1, at least the exterior of the holder comprising a rubber material.

5. The barber brush apparatus of claim 1, at least the exterior of the holder comprising a plastic material.

6. The barber brush apparatus of claim 1, at least the exterior of the holder comprising an elastic material.

7. A barber brush apparatus worn by a user during a hair cutting session to remove cut hair and debris from the cutting blades of a clipper apparatus, the brush apparatus comprising:

a. a contoured, elongated base;

b. a plurality of bristle members upstanding from and supported by the base, with the plurality of bristle members arranged in a single row and grouped into columns along the length of the base; and c. a tubular holder having a plurality of spaced apart raised ridge members, each extending the length of the holder, a depression defined at the top of the holder, and a bore defined within the holder longitudinally therethrough, with the base affixed within the depression and the base having a length longer than the holder, wherein each end of the base overhangs the holder, and with at least the bore being made from a stretchable material for adjusting and adapting the size of the bore to the size of the user's finger, d. wherein the holder is adapted for insertion over at least one of the user's fingers, with the base and the plurality of bristle members being positioned upwardly and outwardly from the user's hand so that movement of the user's hand, and thereby the bristle members, about the clipper blades to remove the cut hair and debris, and wherein the stretchable material within the holder adapted to remain on the user's finger until removed.

8. The barber brush apparatus of claim 7, each of the plurality of bristle members comprising soft bristles.

9. The barber brush apparatus of claim 8, the base being rigid, with the plurality of bristle members secured and supported within the base.

10. The barber brush apparatus of claim 8, the plurality of bristle members further comprising a proximate portion at the base of the apparatus and a distal portion opposite the base of the apparatus, with the distal portion of the bristle members tapering to a terminal end of the bristle members.

11. The barber brush apparatus of claim 7, at least the exterior of the holder comprising a rubber material.

12. The barber brush apparatus of claim 7, at least the exterior of the holder comprising a plastic material.

13. The barber brush apparatus of claim 7, at least the exterior of the holder comprising an elastic material.

14. A barber brush apparatus worn by a user during a hair cutting session to remove cut hair and debris from the cutting blades of a clipper apparatus, the brush apparatus comprising:

a. a contoured, elongated rigid base, with the base supporting a plurality of soft bristle members;

b. the plurality of soft bristle members upstanding from the base, with the plurality of bristle members arranged in a single row and grouped into columns along the length of the base, wherein the plurality of bristle members further comprising a proximate portion at the base of the apparatus and a distal portion opposite the base of the apparatus, with the distal portion of the bristle members tapering to a terminal end of the bristle members; and c. a tubular holder having a plurality of spaced apart raised ridge members, each extending the length of the holder, a depression defined at the top of the holder, and a bore defined within the holder longitudinally therethrough, with the base affixed within the depression and the base having a length longer than the holder, wherein each end of the base overhangs the holder, with at least the bore being made from a stretchable material for adjusting and adapting the size of the bore to the size of the user's pinky finger, with the bore used as a sleeve;

d. wherein the holder is adapted for insertion over at least one of the user's fingers, with the base and the plurality of bristle members being positioned upwardly and outwardly from the user's hand so that movement of the user's hand, and thereby the bristle members, about the clipper blades to remove the cut hair and debris without moving away from the user's workstation or the hair cutting subject, and wherein the stretchable material within the holder adapted to remain on the user's finger until removed.

15. The barber brush apparatus of claim 14, at least the exterior of the holder comprising a rubber material.

16. The barber brush apparatus of claim 14, at least the exterior of the holder comprising a plastic material.

17. The barber brush apparatus of claim 14, at least the exterior of the holder comprising an elastic material.

18. The barber brush apparatus of claim 14, the plurality of soft bristle members having a length longer than the base width and shorter than the diameter of the holder.

* * * * *